US006942460B2

(12) United States Patent
Osako et al.

(10) Patent No.: US 6,942,460 B2
(45) Date of Patent: Sep. 13, 2005

(54) VANE WHEEL FOR RADIAL TURBINE

(75) Inventors: Katsuyuki Osako, Nagasaki (JP); Takashi Shiraishi, Sagamihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 135 days.

(21) Appl. No.: 10/473,346

(22) PCT Filed: Jan. 6, 2003

(86) PCT No.: PCT/JP03/00009

§ 371 (c)(1),
(2), (4) Date: Sep. 29, 2003

(87) PCT Pub. No.: WO03/058038

PCT Pub. Date: Jul. 17, 2003

(65) Prior Publication Data

US 2004/0115044 A1 Jun. 17, 2004

(30) Foreign Application Priority Data

Jan. 4, 2002 (JP) ..... 2002-000128

(51) Int. Cl.[7] ..... F01D 5/14
(52) U.S. Cl. ..... 416/185
(58) Field of Search ..... 416/185, 188

(56) References Cited

U.S. PATENT DOCUMENTS 3,040,670 A * 6/1962 Schenck et al. ..... 415/160
4,659,288 A 4/1987 Clark et al.
5,061,154 A 10/1991 Kington
5,605,444 A * 2/1997 Paton et al. ..... 416/183

FOREIGN PATENT DOCUMENTS

| | | | |
|---|---|---|---|
| EP | 0184934 | 6/1986 | |
| JP | 61-39402 | 3/1986 | |
| JP | 61-142301 | 6/1986 | |
| JP | 4-52504 | 5/1992 | |
| JP | 5-502711 | 5/1993 | |
| JP | 10131704 A * | 5/1998 | ..... F01D/5/14 |
| WO | 91/09209 | 6/1991 | |

* cited by examiner

*Primary Examiner*—Ninh H. Nguyen
(74) *Attorney, Agent, or Firm*—Wenderoth, Lind & Ponack, L.L.P.

(57) ABSTRACT

A radial turbine impeller is provided, comprising a circular main disk provided with a plurality of blades, each having a negative pressure surface and a positive pressure surface; scallops being formed by cutting off the main disk between the negative pressure surface of the one blade and the positive pressure surface of the other blade adjacent to the one blade, respectively; wherein a minimum radius portion of the scallop having a minimum distance between a center of the circular main disk and the edge of the scallop is positioned closer to the positive pressure surface so that the scallop is asymmetric between the negative pressure surface of the one blade and the positive pressure surface of the other blade adjacent thereto.

7 Claims, 7 Drawing Sheets

SECTION VIEW OF A-A

SECTION VIEW OF B-B

VANE WHEEL FOR RADIAL TURBINE

BACKGROUND OF THE INVENTION

1. Field of the Invention

The present invention relates to an impeller used for a radial turbine such as a micro gas turbine, an expander turbine or a supercharger.

2. Description of the Related Art

An impeller used for a radial turbine, such as a micro gas turbine, an expander turbine or a supercharger is generally constituted by a plurality of blades; i.e., rotor blades; and a main disk provided with these rotor blades.

FIG. 5 is a front view of part of a prior art radial turbine impeller. As shown in FIG. 5, the impeller 110 is generally circular, and a plurality of rotor blades 400 are arranged on a rotary axis 120 of the impeller 110 generally at equal intervals in the circumferential direction. Paddle-like scallops 300 are formed between every two adjacent rotor blades 400 in the vicinity of the outer circumference of a main disk 200. As is apparent from FIG. 5, the scallop 300 is formed between a negative pressure surface 410 of the rotor blade 400 and a positive pressure surface 420' of the rotor blade 400' adjacent to the former. The scallops 300 are formed by cutting off the main disk 200 along the rotor blade from the outer circumference of the main disk 200 to a predetermined distance. In the main disk 200 in which the scallops 300 are formed, a minimum radius portion from the rotary axis 120 of the impeller 110 to an outer edge of the scallop 300 is located generally at a center between the two rotor blades 400 and 400'. Accordingly, the scallops 300 are symmetric in the left/right direction relative to the minimum radius portion. The scallops 300 serve to reduce a centrifugal force and a moment of inertia in the impeller 110.

FIG. 6*a* is a perspective view of the prior art radial turbine impeller. As shown by arrows F1 and F2, a fluid enters the impeller 110 in the vertical direction relative to the rotary axis 120 of the impeller 110 and then flows out from a turbine exit 160 in the parallel direction relative to the rotary axis 120. However, as a gap is formed between a casing (not shown) and a back surface of the impeller 110 when the scallop 300 is formed, a leakage FR, flowing from a positive pressure surface 420 to the negative pressure surface 410 is formed. To reduce the leakage, for example, in Japanese Unexamined Patent Publication (Kokai) No. 10-131704, a radial turbine impeller is disclosed, having scallops, each being asymmetric in the left/right direction so that the minimum radius portion of the scallops 300 are deviated, from a center of an area between the adjacent two blades, to be closer to the negative pressure surface of the blade.

However, in the prior art radial turbine impeller and the radial turbine impeller disclosed in Japanese Unexamined Patent Publication (Kokai) No. 10-131704, another problem occurs due to the scallop 300 formed by cutting off the main disk 200. This problem will be explained with reference to FIGS. 7*a*, 7*b*, 7*c* and 6*b*. In this regard, FIGS. 7*a*, 7*b* and 7*c* are an illustration of part of the prior art radial turbine impeller (a meridian plane), a sectional view taken along a line A—A in FIG. 7*a* as seen from upstream in the flowing direction, and a sectional view taken along a line B—B in FIG. 7*a* as seen from upstream in the flowing direction, respectively; and FIG. 6*b* is a side sectional view of the prior art radial turbine impeller. As shown in FIG. 6*b*, a flow F1 of the fluid flowing into the impeller 110 impinges on the edge of the scallop 300, causing a secondary flow FA (FIG. 7*a*) on the negative pressure surface 410 rising toward a rotor blade exit shroud 450, and a secondary flow on a surface of a hub 150 directing to the negative pressure surface 410. Thereby, as shown in FIG. 7*b*, corner vortices 500 generate in an area on the negative surface 410 of the rotor blade 400 closer to the hub 150. Such corner vortices 500 are low-energy fluids and gather together in an area closer to the shroud 450 of the negative pressure surface 410 in the vicinity of the exit of the rotor blade 400 (FIG. 7*c*). Thereby, the uniformity of the flow is disturbed to lower the effect of the turbine.

According to the radial turbine impeller disclosed in Japanese Unexamined Patent Publication No. 10-131704, it is possible to prevent the efficiency of the turbine from lowering due to the leakage occurring on the back surface of the impeller. However, as this impeller is not formed so that part of the scallop is adjacent to the negative pressure surface 410, it is impossible to prevent the efficiency of the turbine from lowering due to the generation of the corner vortices as in the prior art radial turbine impeller.

Accordingly, an object of the present invention is to provide a radial turbine impeller which prevents the efficiency of the turbine from lowering caused by the impingement of fluid onto the edge of the scallop.

DISCLOSURE OF THE INVENTION

To achieve the above-mentioned object, according to one embodiment of the present invention, a radial turbine impeller is provided, comprising a circular main disk provided with a plurality of blades, each having a negative pressure surface and a positive pressure surface; scallops being formed by cutting off the main disk between the negative pressure surface of the one blade and the positive pressure surface of the other blade adjacent to the one blade, respectively; wherein a minimum radius portion of the scallop having a minimum distance between a center of the circular main disk and the edge of the scallop is positioned closer to the positive pressure surface so that the scallop is asymmetric between the negative pressure surface of the one blade and the positive pressure surface of the other blade adjacent thereto.

That is, according to the embodiment of the present invention, as the scallop project from the negative pressure surface of the rotor blade, it is possible to suppress the generation of corner vortecies in an area of the scallop closer to the negative pressure surface and, as a result, to prevent the efficiency of the turbine from lowering.

BEST MODE FOR CARRYING OUT THE INVENTION

Figure 1:
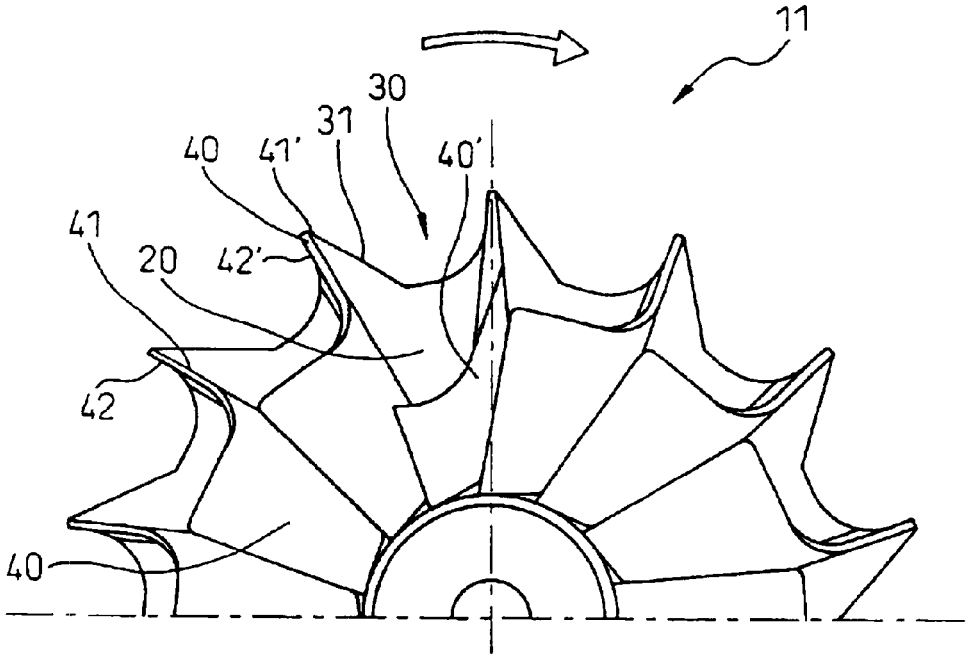
FIG. 1 is a front view of part of a radial turbine impeller according to the present invention.

The preferred embodiments of the present invention will be described below with reference to the attached drawings, wherein the same reference numerals are used to denote the same elements. To help understanding, the scales of the respective drawings are suitably changed and part of a rotor blade of the impeller is properly eliminated.

FIG. 1 is a front view of part of a radial turbine impeller according to the present invention. A plurality of blades, for example, rotor blades 40 are radially arranged in a main disk 20 of a radial turbine impeller 11. In a similar manner as in the above-mentioned prior art radial turbine impeller, a scallop 30 is formed between adjacent rotor blades 40, 40', by cutting off part of the circular main disk 20 from the outer circumference thereof. As shown in FIG. 1, the scallops 30 are formed between every adjacent two rotor blades 40 provided in the radial turbine impeller 11.

Figure 2A:
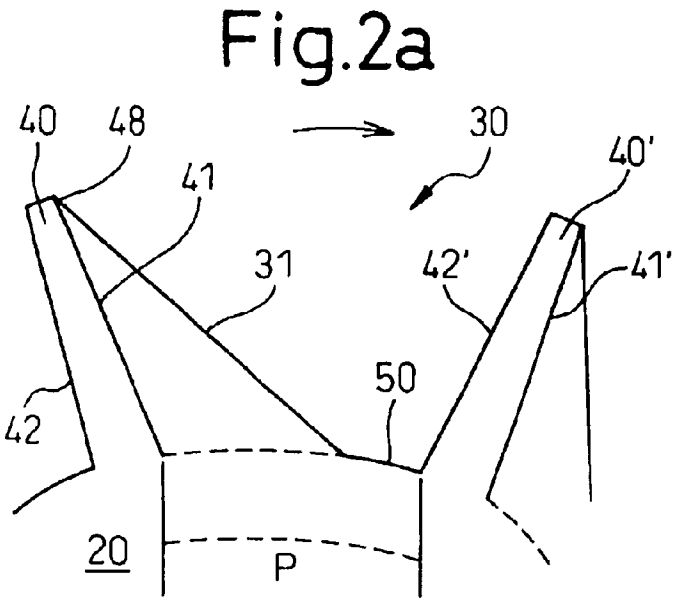
FIG. 2*a* is an enlarged view of part of the radial turbine impeller according to a first embodiment of the present invention as seen from an exit of the turbine.

FIG. 2*a* is an enlarged view of part of the radial turbine impeller according to a first embodiment of the present invention as seen from an exit of the turbine. In FIG. 2*a*, part of the circular main disk 20 is illustrated in which adjacent two rotor blades 40 and 40' are radially provided. By cutting off the circular main disk 20 from the outer circumference thereof as described before, the scallop 30 is formed between these rotor blades 40 and 40'. As apparent from FIG. 2*a*, the scallop 30 is formed in an area of the main disk 20 positioned between a negative pressure surface 41 of the rotor blade 40 and a positive pressure surface 42' of the rotor blade 40'. According to this embodiment, a minimum radius portion 50 in which a distance between a rotary axis 12 (not shown) and the edge of the scallop 30 is minimum is located at a position closer to the positive pressure surface 42' than a center between the two rotor blades 40 and 40'. That is, if a circumferential distance from the rotor blade 40 to the rotor blade 40' is defined as P, the minimum radius portion 50 is located between 0.5 P and P. Further, in this embodiment, the edge of the scallop 30 connecting a tip end 48 of the negative surface 41 in the rotor blade 40 to the minimum radius portion 50 is formed by a single straight line portion 31. Accordingly, the scallop 30 of the impeller 11 in the present invention projects from the negative pressure surface 41 of the rotor blade 40 toward the positive pressure surface 42' of the rotor blade 40' adjacent to the former, whereby the scallop 30 is asymmetric relative to the rotor blades 40, 40' adjacent to each other.

By forming the outer circumference of the main disk 20 or the scallop 30 in such a manner, it is possible to prevent the secondary flow flowing toward the negative pressure surface 41 from being generated on a surface of a hub 15, and as a result, to suppress the generation of the corner vortecies on the negative pressure surface 41 of the rotor blade 40. Therefore, as the corner vortices are prevented from gathering in the vicinity of the exit of the rotor blade on the negative pressure surface shroud by shaping the scallop 30 as described hereinbefore, it is possible to avoid the lowering of the turbine efficiency. Further, as part of the scallop 30 is formed by a straight line portion, it is possible to form the scallop 30 easily.

Figure 2B:
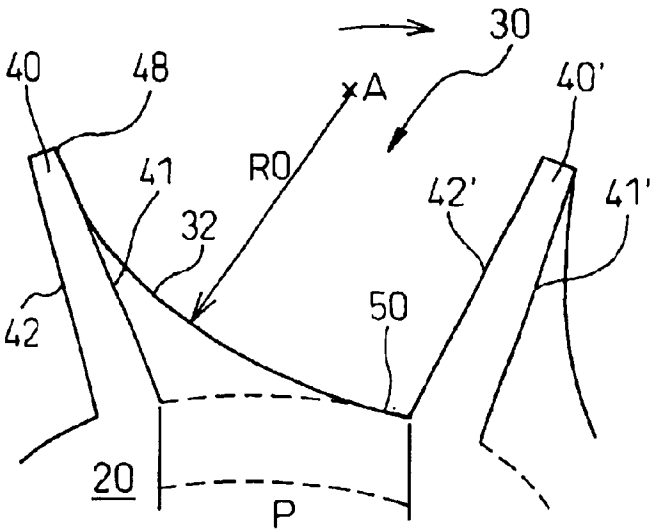
FIG. 2*b* is an enlarged view of part of the radial turbine impeller according to a second embodiment of the present invention as seen from an exit of the turbine.

FIG. 2*b* is enlarged view of part of a radial turbine impeller according to a second embodiment of the present invention as seen from a turbine exit. In the case of this embodiment, an edge of a scallop 30 connecting a tip end 48 of a rotor blade 40 on the negative pressure surface 41 thereof to a minimum radius portion 50 is formed by a single curved line portion 32. In this embodiment, this curved line portion 32 is an arc having a center A and a radius of RO. Further, in the same manner as the preceding embodiment described before, the minimum radius portion 50 is positioned closer to a positive pressure surface 42' than a center between the two rotor blades 40 and 40'. Accordingly, if a circumferential distance from the rotor blade 40 to the rotor blade 40' is defined as P, the minimum radius portion 50 is located between 0.5 P and P.

Also in this embodiment, it is possible to prevent the secondary flow flowing to the negative pressure surface 41 from being generated on the surface of a hub 15, and as a result, to prevent the corner vortecies from generating on the negative pressure surface 41 of the rotor blade 40. Therefore, since the corner vortecies are prevented from gathering in the vicinity of the exit of the rotor blade on the negative pressure surface shroud by shaping the scallop 30 as described hereinbefore, it is possible to avoid the lowering of the turbine efficiency, and to form the curve of the scallop 30 easily.

Figure 3B:
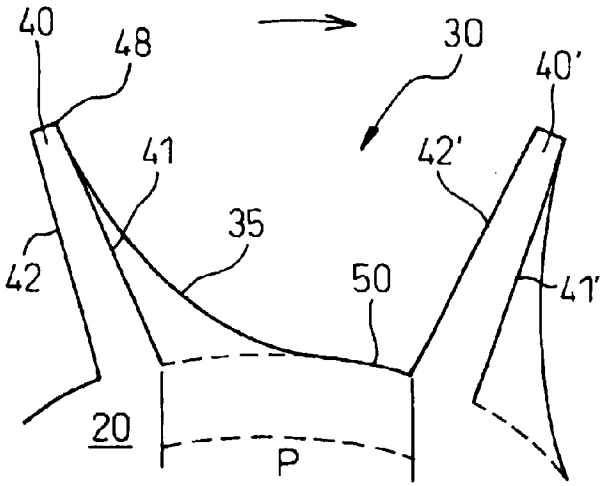
FIG. 3*b* is an enlarged view of part of the radial turbine impeller according to a fourth embodiment of the present invention as seen from an exit of the turbine.
Figure 3A:
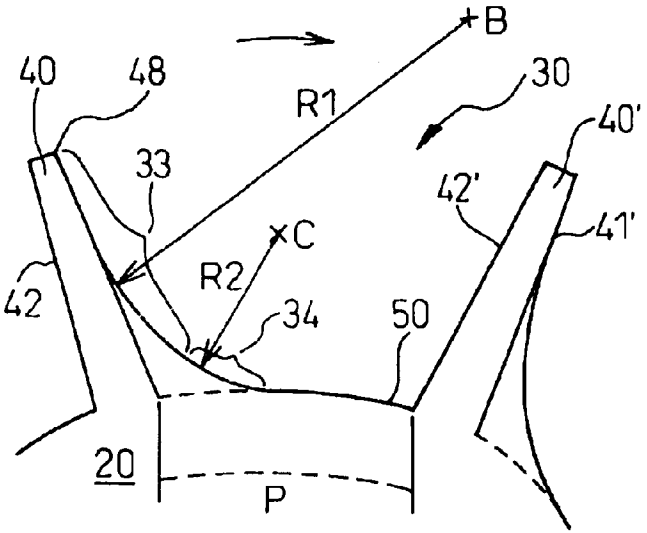
FIG. 3*a* is an enlarged view of part of the radial turbine impeller according to a third embodiment of the present invention as seen from an exit of the turbine.

FIG. 3*a* is enlarged view of part of a radial turbine impeller according to a third embodiment of the present invention as seen from a turbine exit. In this embodiment, an edge of a scallop 30 connecting a tip end 48 of a rotor blade 40 on the negative pressure surface 41 thereof to a minimum radius portion 50 is formed by two curved line portions 33 and 34. In this embodiment, these curved line portion are arcs having centers B and C and radii of R1 and R2, respectively. Further, in the same manner as the preceding embodiment described before, the minimum radius portion 50 is positioned closer to a positive pressure surface 42' than a center between the two rotor blades 40 and 40'. Accordingly, if a circumferential distance from the rotor blade 40 to the rotor blade 40' is defined as P, the minimum radius portion 50 is located between 0.5 P and P.

Also in this embodiment, it is possible to prevent the secondary flow flowing to the negative pressure surface 41 from being generated on the surface of a hub 15, and as a result, to prevent the corner vortecies from generating on the negative pressure surface 41 of the rotor blade 40. Therefore, the corner vortecies are prevented from gathering in the vicinity of the exit of the rotor blade on the negative pressure surface shroud by shaping the scallop 30 as described hereinbefore. Also, since a smooth shape portion is formed between the tip end 48 and the minimum radius portion 50, it is possible for the fluid to flow smoothly, and as a result, to further avoid the lowering of the turbine efficiency. By forming the curve as part of a parabola, it is possible to form the scallop 30 easily.

Further, FIG. 3*b* is enlarged view of part of a radial turbine impeller according to a fourth embodiment of the present invention as seen from a turbine exit. In this embodiment, an edge of a scallop 30 connecting a tip end 48 of a rotor blade 40 on the negative pressure surface 41 thereof to a minimum radius portion 50 is formed by a single curved line portion 35. In this embodiment, this curved line portion is part of a parabola. Further, in the same manner as the preceding embodiment described hereinbefore, the minimum radius portion 50 is positioned closer to a positive pressure surface 42' than a center between the two rotor blades 40 and 40'. Accordingly, if a circumferential distance from the rotor blade 40 to the rotor blade 40' is defined as P, the minimum radius portion 50 is located between 0.5 P and P.

Also in this embodiment, it is possible to prevent the secondary flow flowing to the negative pressure surface 41 from being generated on the surface of a hub 15, and as a result, to prevent the corner vortecies from generating on the negative pressure surface 41 of the rotor blade 40. Therefore, the corner vortecies are prevented from gathering in the vicinity of the exit of the rotor blade on the negative pressure surface shroud by shaping the scallop 30 as described hereinbefore. Also, since a smooth shape portion is formed between the tip end 48 and the minimum radius portion 50, it is possible for the fluid to flow smoothly, and as a result, to further avoid the lowering of the turbine efficiency.

Figure 4B:
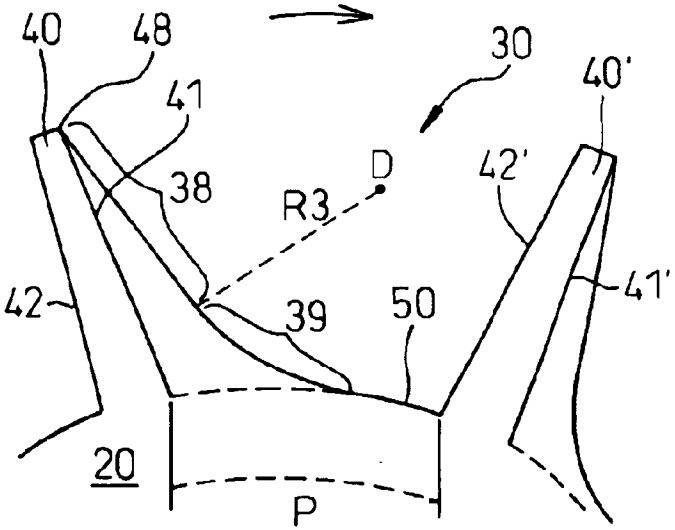
FIG. 4*b* is an enlarged view of part of the radial turbine impeller according to a sixth embodiment of the present invention as seen from an exit of the turbine.
Figure 4A:
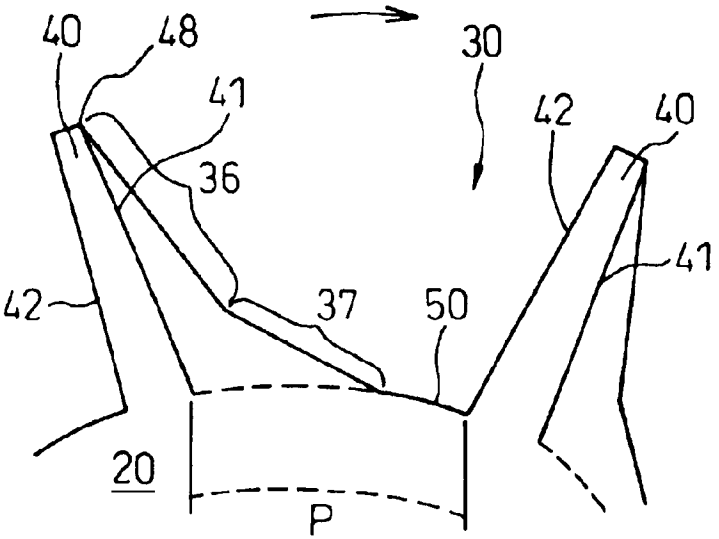
FIG. 4*a* is an enlarged view of part of the radial turbine impeller according to a fifth embodiment of the present invention as seen from an exit of the turbine.
Figure 5:
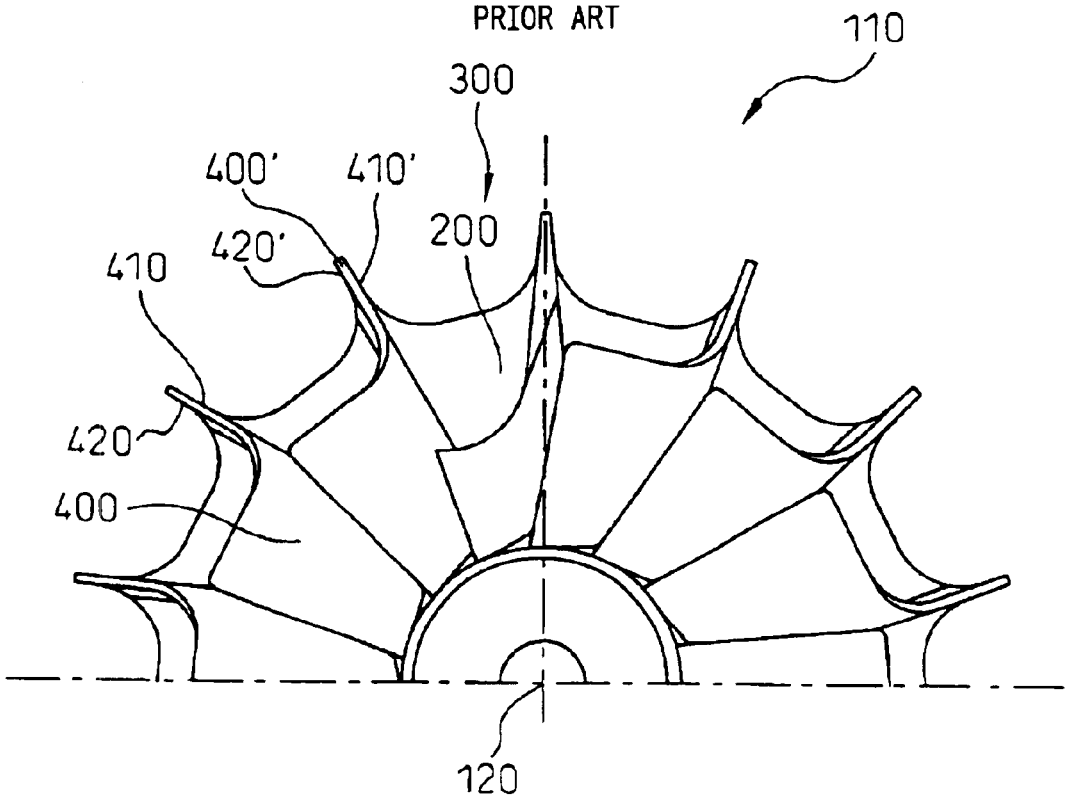
Fig.5 PRIOR ART
FIG. 5 is a front view of part of a prior art radial turbine impeller.
Figure 6A:
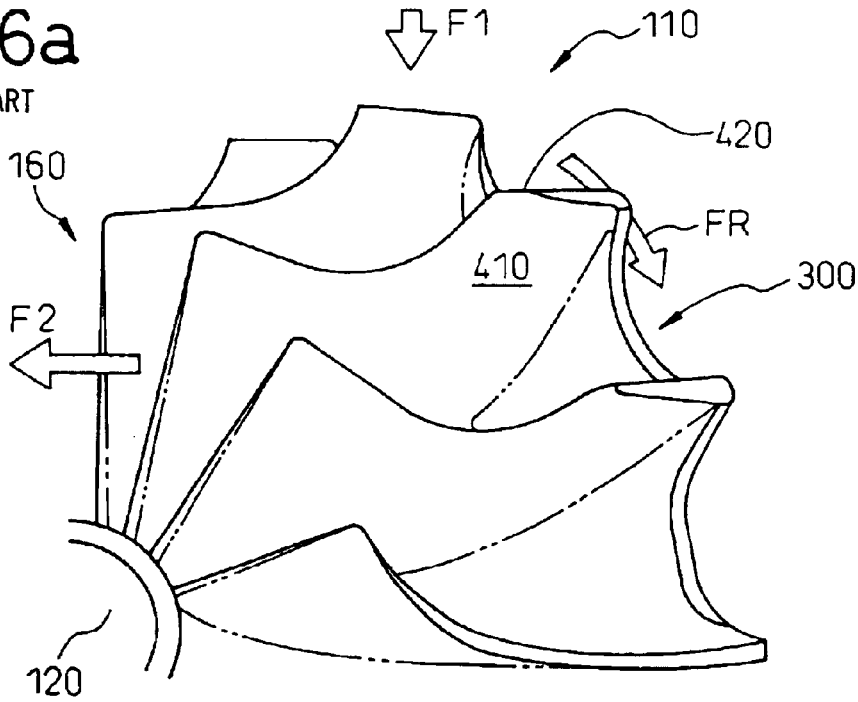
Fig.6a PRIOR ART
FIG. 6*a* is a perspective view of a prior art radial turbine impeller.
Figure 6B:
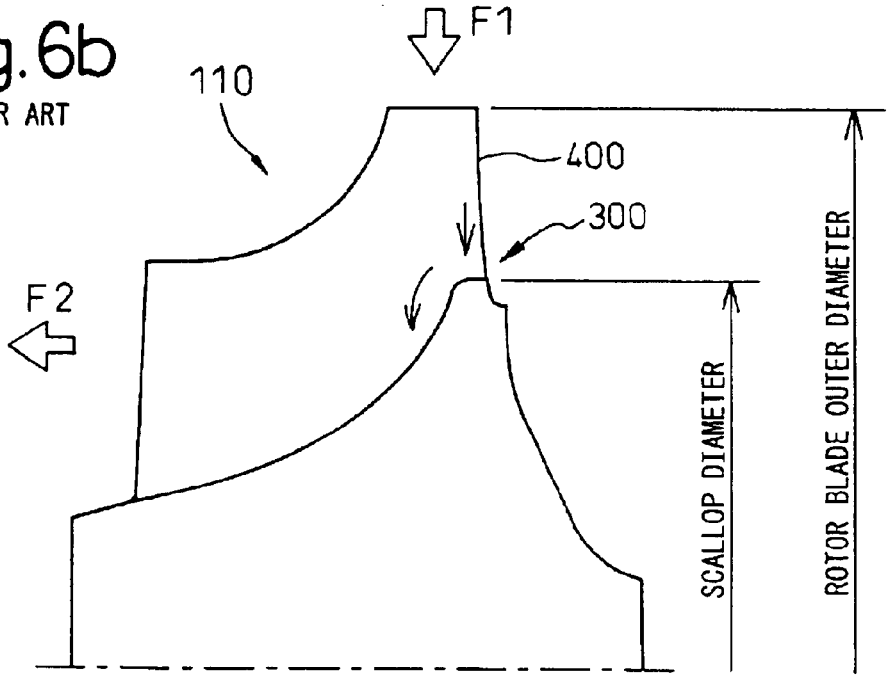
Fig.6b PRIOR ART
FIG. 6*b* is a side sectional view of the prior art radial turbine impeller.
Figure 7A:
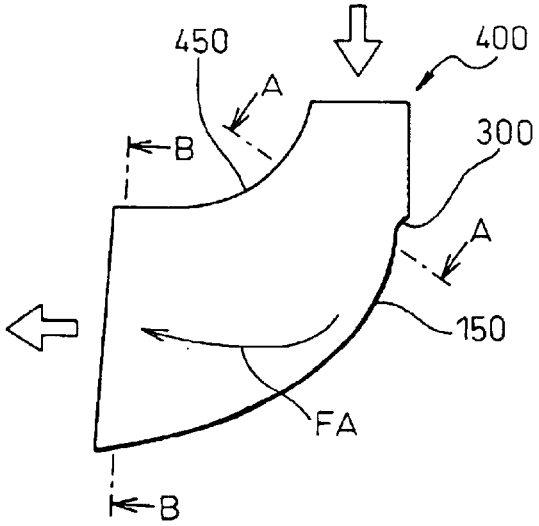
Fig.7a PRIOR ART
FIG. 7*a* is a view of part of the prior art radial turbine impeller.
Figure 7B:
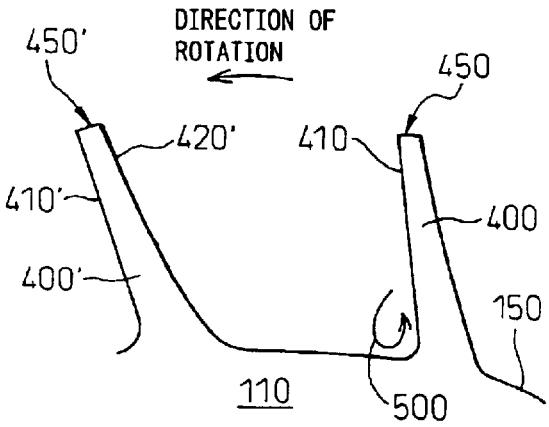
Fig.7b PRIOR ART
FIG. 7*b* is a sectional view taken along a line A—A in FIG. 7*a* as seen from upstream of the flow.
Figure 7C:
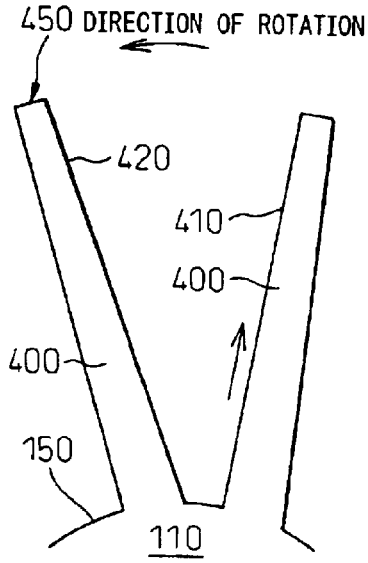
Fig.7c PRIOR ART
FIG. 7*c* is a sectional view taken along a line B—B in FIG. 7*a* as seen from upstream of the flow.

Further, FIG. 4*a* is enlarged view of part of a radial turbine impeller according to a fifth embodiment of the present invention as seen from a turbine exit. In this embodiment, an edge of a scallop 30 connecting a tip end 48 of a rotor blade 40 on the negative pressure surface 41 thereof to a minimum radius portion 50 is formed by two straight line portions 36, 37. In this embodiment, these straight line portions 36, 37 make an obtuse angle. Further, in the same manner as the preceding embodiment described hereinbefore, the minimum radius portion 50 is positioned closer to a positive pressure surface 42' than a center between the two rotor blades 40 and 40'. Accordingly, if a circumferential distance from the rotor blade 40 to the rotor blade 40' is defined as P, the minimum radius portion 50 is located between 0.5 P and P.

Also in this embodiment, it is possible to prevent the secondary flow flowing to the negative pressure surface 41 from being generated on the surface of a hub 15, and as a result, to prevent the corner vortecies from generating on the negative pressure surface 41 of the rotor blade 40. Therefore, the corner vortecies are prevented from gathering in the vicinity of the exit of the rotor blade on the negative pressure surface shroud by shaping the scallop 30 as described hereinbefore. Also, as a smooth shape is formed between the tip end 48 and the minimum radius portion 50, it is possible for the fluid to flow smoothly and, as a result, to further avoid the lowering of the turbine efficiency.

FIG. 4*b* is enlarged view of part of a radial turbine impeller according to a sixth embodiment of the present invention as seen from a turbine exit. In the case of this embodiment, an edge of a scallop 30 connecting a tip end 48 of a rotor blade 40 on the negative pressure surface 41 thereof to a minimum radius portion 50 is formed by a single straight line portion 38 and a single curved line portion 39. In this embodiment, this curved line portion 39 is an arc having a center D and a radius of R3. Further, in the same manner as the preceding embodiment described before, the minimum radius portion 50 is positioned closer to a positive pressure surface 42', than a center between the two rotor blades 40 and 40'. Accordingly, if a circumferential distance from the rotor blade 40 to the rotor blade 40' is defined as P, the minimum radius portion 50 is located between 0.5 P and P.

Also in this embodiment, it is possible to prevent the secondary flow flowing to the negative pressure surface 41 from being generated on the surface of a hub 15 and, as a result, to prevent the corner vortecies from generating on the negative pressure surface 41 of the rotor blade 40. Therefore, the corner vortecies are prevented from gathering in the vicinity of the exit of the rotor blade on the negative pressure surface shroud by shaping the scallop 30 as described hereinbefore. Also, as a smooth shape is formed between the tip end 48 and the minimum radius portion 50, it is possible for the fluid to flow smoothly, and as a result, to further avoid the lowering of the turbine efficiency.

Needless to say, the edge of the main disk 20 connecting the tip end 48 of the negative pressure surface 41 of the rotor blade 40 to the minimum radius portion 50 may be a combination of at least one curved line portion or at least one straight line portion, or the curved line may be other configurations except for an arc or part of a parabola. In either of these cases, the same effect is obtainable.

According to any of the embodiments according to the present invention, it is possible to obtain an effect of suppressing the generation of corner vortecies in the scallop on the negative pressure surface side and, as a result, to prevent the turbine efficiency from lowering, which is a common effect thereof.

What is claimed is:

1. A radial turbine impeller, comprising a circular main disk provided with a plurality of blades, each having a negative pressure surface and a positive pressure surface; scallops being formed by cutting off the main disk between the negative pressure surface of the one blade and the positive pressure surface of the other blade adjacent to the one blade, respectively; wherein a minimum radius portion of the scallop having a minimum distance between a center of the circular main disk and the edge of the scallop is positioned closer to the positive pressure surface so that the scallop is asymmetric between the negative pressure surface of the one blade and the positive pressure surface of the other blade adjacent thereto.

2. A radial turbine impeller as defined by claim 1, wherein an edge of the scallop located between a tip end of the blade on the negative pressure surface of the side and the minimum radius portion of the circular main disk is formed by a single straight line portion.

3. A radial turbine impeller as defined by claim 1, wherein an edge of the scallop located between a tip end of the blade on the negative pressure surface side and the minimum radius portion of the circular main disk is formed by at least two straight line portions.

4. A radial turbine impeller as defined by claim 1, wherein an edge of the scallop located between a tip end of the blade on the negative pressure surface side and the minimum radius portion of the circular main disk is formed by at least one curved line portion.

5. A radial turbine impeller as defined by claim 4, wherein the curved line portion is an arc or a part of a parabola.

6. A radial turbine impeller as defined by claim 1, wherein an edge of the scallop located between a tip end of the blade on the negative pressure surface side and the minimum radius portion of the circular main disk is formed by at least one straight line portion and at least one curved line portion.

7. A radial turbine impeller as defined by claim 6, wherein the curved line portion is an arc or a part of a parabola.

* * * * *